US006748355B1

(12) United States Patent
Miner et al.

(10) Patent No.: US 6,748,355 B1
(45) **Date of Patent: *Jun. 8, 2004**

(54) METHOD OF SOUND SYNTHESIS

(75) Inventors: Nadine E. Miner, Albuquerque, NM (US); Thomas P. Caudell, Tijeras, NM (US)

(73) Assignee: Sandia Corporation, Albuquerque, NM (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 983 days.

(21) Appl. No.: 09/014,871

(22) Filed: Jan. 28, 1998

(51) Int. Cl.[7] ..... G10L 19/02
(52) U.S. Cl. ..... 704/203; 704/258
(58) Field of Search ..... 704/258, 269, 704/278

(56) References Cited

PUBLICATIONS

Kudumakis et al "Synthesis of audio signals using wavelet transform",1993, IEEE, pp. 1–4.*
Giovanni et al "Application of time–frequency and time–scale methods to the analysis, synthese, and transformation of natural sounds" 1991, pp. 44–85.*
Faria et al "Wavelets in music analysis and synthesis : timbres analysis and perspectives" SPIE proceedings 1996, p. 950–961, Aug. 9, 1996.*
Evangelista "Pitch–syncronous wavelet representation of speech and music signals" Signal Processing, IEEE transactions, Dec. 1993 vol. 41 issue 12 pp. 3313–3330.*
Rioul et al "Wavelets and signal processing" IEEE signal processing magazine, pp. 14–38 Oct. 1991 vol. 8 issue 4.*
Gullemain et al " Parameters estimation through continuous wavelet transform for synthesis of audio–sounds" Audio Engineering Society repprint, 1991.*
Kronland–Martinet "Application of time frequency and time scale methods (wavelet transforms) to the analysis, synthesis, and transfromation of natural sounds" Reptresentations of musical signals, MIT Press, 1991.*
William W. Gaver, *Using and Creating Auditory Icons,* Auditory Display, Ed. Gregory Kramer, SFI Studies in the Sciences of Complexity, Proc. vol. XVIII, Addison–Wesley, 1994.
Kees van den Doel and Dinesh K. Pai, *Synthesis of Shape Dependent Sounds with Physical Modeling,* The Proceedings of ICAD '96 (International Conference on Auditory Display).
Perry R. Cook, *Physically Informed Sonic Modeling (PhISM): Synthesis of Percussive Sounds,* Computer Music Journal, 21:3, p. 38–49, Fall 1997.
Perry R. Cook, *Speech and Singing Synthesis Using Physical Models: Some History and Future Directions,* Greek Physical Modeling Conference, 1995.
Julius O. Smith, III, *Physical Modeling Using Digital Waveguides,* Computer Music Journal, vol. 16, No. 4, Winter 1992.

(List continued on next page.)

*Primary Examiner*—Tālivaldis Ivars Šmits
(74) *Attorney, Agent, or Firm*—V. Gerald Grafe; Kevin W. Bieg

(57) ABSTRACT

A sound synthesis method for modeling and synthesizing dynamic, parameterized sounds. The sound synthesis method yields perceptually convincing sounds and provides flexibility through model parameterization. By manipulating model parameters, a variety of related, but perceptually different sounds can be generated. The result is subtle changes in sounds, in addition to synthesis of a variety of sounds, all from a small set of models. The sound models can change dynamically according to changes in the simulation environment. The method is applicable to both stochastic (impulse-based) and non-stochastic (pitched) sounds.

25 Claims, 3 Drawing Sheets

OTHER PUBLICATIONS

A. Freed, CNMAT, *Synthesis and Control of Hundreds of Sinusoidal Paratials on a Desktop Computer without Custom Hardware,* Proc. ICSPAT, 1993.

Xavier Serra and Julius Smith, III, *Spectral Modeling Synthesis: A Sound Analysis/Snythesis System Based on a Deterministic plus Stochastic Decomposition,* Computer Music Journal, vol. 14, No. 4, Winter 1990.

James K. Hahn, *An Integrated Approach to Motion and Sound,* The Journal of Visualization and Computer Animation, vol. 6:109–123 (1993).

Tapio Takala and James Hahn, *Sound Rendering,* Computer Graphics, 26, July 2, 1992.

Ken C. Pohlmann and Will Pirkle, *The Shifting Soundscape,* PC Magazine, Jan. 6, 1998.

Wavelet Toolbox User's Guide, Mar. 1996, The MathWorks, Inc.

Frank Beacham, *Sound Design for the Interactive Era,* Pro Audio Review, Sep. 1997.

* cited by examiner

METHOD OF SOUND SYNTHESIS

This invention was made with Government support under Contract DE-AC04-94AL85000 awarded by the U.S. Department of Energy. The Government has certain rights in the invention.

BACKGROUND OF THE INVENTION

This invention relates to the field of sound synthesis, specifically synthesis of a wide range of perceptually convincing sounds using parameterized sound models.

Sound synthesis can be applied in a wide variety of systems including, for example, virtual reality (VR), multimedia, computer gaming, and the world wide web. Applications where sound synthesis can be particularly useful include, for example, training, data analysis and auralization, multi-media documentation and instruction, and dynamic sound generation for computer gaming and entertainment.

Pre-Recorded, Pre-Digitized Sounds

Most current VR, multimedia, gaming and software simulation systems utilize pre-recorded, pre-digitized sounds rather than synthesized sounds. Pre-digitized sounds are static and can not be changed in response to user actions or to changes within a simulation environment. Obtaining an application-specific sound sequence can be difficult and can require sophisticated sound editing hardware and software. There can be a 2000:1 ratio of field time to useable digitized sound; in other words, 2000 hours of field and editing time can be required to obtain 1 hour of application specific digitized sound. Creating an acoustically rich virtual environment requires thousands of sounds and variations of those sounds. Thus, obtaining the vast digitized sound library required for rich and compelling acoustic experiences is impractical.

Wavetable synthesis is a pre-digitized sound method that is commonly used in synthesizer keyboards and PC sound cards. See, e.g., Pohlmann, "The Shifting Soundscape," PC Magazine, Jan. 6, 1998. Sounds are digitized and stored in computer memory. When applications request a particular sound sample, the sound is processed, played back and looped over. This method has the same short-comings as those discussed for pre-digitized sound: sounds are not dynamic in nature, and it is costly to obtain large quantities of digitized sounds.

The alternative to using pre-digitized sound is to synthesize sounds as needed. Unfortunately, there are no sound synthesis methods available which can provide flexible, real-time sound synthesis of a wide variety of sounds. Some existing sound synthesis methods can synthesize a narrow range of sounds, but are not extensible to synthesize a wide variety of sounds.

Physical Modeling Synthesis

Physical characteristics of objects involved can be modeled to synthesize sound. The disadvantage to this approach is that the resulting models are not generalizable to many different types of sounds. In addition, unless very complex physical models are used, perceptually convincing synthesis is not achieved.

Gaver developed a parameterized model based on a simple physical equation for impact, scraping, breaking and bouncing sounds. See, e.g., Gaver, "Using and Creating Auditory Icons," in G. Kramer (Ed.) *Auditory display: Sonification, audification, and auditory interfaces*, Reading, Mass., Addison-Wesley, 1994, pp. 417–446. Gaver's method yielded parameterized models, but did not produce perceptually convincing sounds.

Others have created parameterized synthesis models for impacts based on the physical equations of the objects involved. Doel's approach produced sounds that were not perceptually convincing, and the method was not generalizable to a wide class of sounds. Doel & Pai, "Synthesis of Shape Dependent Sounds with Physical Modeling," *Proceedings of the* 1996 *International Conference on Auditory Displays*, November 4–6, Palo Alto, Calif. Cook's approach yielded perceptually convincing sounds, but parameterization was difficult and the resulting models were not generalizable. Cook, "Physically Informed Sonic Modeling (PhISM): Synthesis of Percussive Sounds," *Computer Music Journal*, 21(3), 1997, pp. 38–49.

The digital waveguide method has been used for developing physical models of string, wind and brass instruments and the human singing voice. See, e.g., Cook, "Speech and Synthesis Using Physical Models: Some History and Future Directions," Greek Physical Modeling Conference, 1995; Smith, "Physical Modeling using Digital Waveguides," *Computer Music Journal*, Vol. 16, No. 4, 1992. The models involved are specific to one type of instrument and are extremely complex. Excellent quality music synthesis is obtained and some high-end synthesizer keyboards have been based on this technique. However, the technique is not extensible to general sound synthesis.

Spectral Synthesis

Other researchers have investigated spectral synthesis using Fourier analysis or Short-Time Fourier Transform (STFT). See, e.g., Freed, Rodet, & Depalle, "Synthesis and Control of Hundreds of Sinusoidal Partials on a Desktop Computer without Custom Hardware," *Proceedings of the International Conference on Signal Processing, Applications and Technology* (ICSPAT), 1993; Serra, "Spectral Modeling Synthesis: a Sound Analysis/Synthesis System Based on a Deterministic plus Stochastic Decomposition," *Computer Music Journal*, Vol. 14, No. 4, Winter 1990. Spectral synthesis starts with Fourier analysis of a base sound. Fourier methods, however, do not adequately model the time varying nature of real-world signals. STFTs capture the frequency information for different blocks of time, but the time resolution is limited and fixed by the choice of window size. Furthermore, stochastic components of sounds are often lost with STFT techniques, which reduces the realistic quality of subsequently synthesized sounds.

Freed investigated additive synthesis of sound analyzed with Fourier transforms. Freed's approach required summation of thousands of sinusoids for producing a single synthesized sound. Generalizable, parameterized sound models were not attained.

Serra used STFTs to analyze musical instrument sounds. To preserve the realistic nature, stochastic components were added back in during synthesis. Serra's approach is not easily parameterizable or extensible due to limitations of the STFT.

FM synthesis is another spectral approach which combines two or more sinusoidal waves to form more complex waveforms. The sounds synthesized with this method are "electronic" and artificial sounding. This method does not synthesize perceptually convincing natural sounds.

Accordingly, there is a need for sound synthesis methods that create perceptually convincing sound models for both pitched and stochastic based sounds, are generalizable to synthesize a broad class of sounds, and can synthesize sound variations in real-time.

SUMMARY OF THE INVENTION

The present invention provides a sound synthesis method that can create perceptually convincing sound models that are generalizable to synthesize a broad class of sounds (both pitched and stochastic based sounds), and can synthesize sound variations in real-time. The present method uses wavelet decomposition and synthesis for creating dynamic, parameterized models. The method is based on the spectral properties of a sound and takes the stochastic components of the sound into consideration for creating perceptually convincing synthesized sounds. Wavelet analysis provides a time-based windowing technique with variable-sized windows. Stochastic components are maintained through the analysis process and can be manipulated during parameterization and reconstruction. The result is generalizable sound models and perceptually convincing sound synthesis.

A wavelet decomposition can be used to obtain a wavelet representation of a digitized sound. The wavelet representation can then be parameterized, for example by grouping related wavelet coefficients. The parameterized wavelet representation can then be manipulated to generate a desired synthesized sound. An inverse wavelet transform can construct the synthesized sound, having the desired characteristics, from the parameterized wavelet representation after parameter manipulation. The synthesized sound can then be communicated, for example by generating audio signals or by storing for later use.

Advantages and novel features will become apparent to those skilled in the art upon examination of the following description or may be learned by practice of the invention. The objects and advantages of the invention may be realized and attained by means of the instrumentalities and combinations particularly pointed out in the appended claims.

DESCRIPTION OF THE FIGURES

The accompanying drawings, which are incorporated into and form part of the specification, illustrate embodiments of the invention and, together with the description, serve to explain the principles of the invention.

DETAILED DESCRIPTION OF THE INVENTION

The present invention provides a sound synthesis method that can create perceptually convincing sound models that are generalizable to synthesize a broad class of sounds (both pitched and stochastic based sounds), and can synthesize sound variations in real-time. The present method uses wavelet decomposition and synthesis for creating dynamic, parameterized models. The method is based on the spectral properties of a sound and takes the stochastic components of the sound into consideration for creating perceptually convincing synthesized sounds. Wavelet analysis provides a time-based windowing technique with variable-sized windows. Stochastic components are maintained through the analysis process and can be manipulated during parameterization and reconstruction. The result is generalizable sound models and perceptually convincing sound synthesis.

Figure 1:
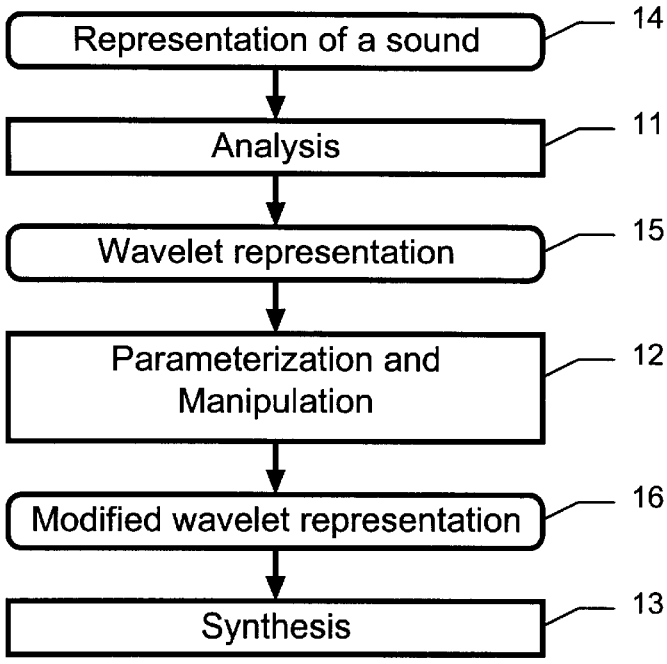
FIG. 1 is a flow diagram of a sound synthesis method according to the present invention.

The sound synthesis method of the present invention can be described in three parts: analysis, parameterization, and synthesis, as shown in FIG. 1. Analysis 11 obtains a first wavelet representation 15 from a representation 14 of a sound. Parameterization 12 generates a modified wavelet representation 16 from the first wavelet representation 15 by parameterizing and manipulating the first wavelet representation 15. Synthesis 13 synthesizes a sound from the modified wavelet representation 16.

Analysis

Analysis begins with a sound sample, for example a digitized representation of a sound. Those skilled in the art appreciate various ways for obtaining sound samples and for obtaining digitized representations of sounds. By examination of the sound sample, an appropriate wavelet type for the signal decomposition can be determined, i.e., a wavelet type that provides a set of coefficients that can be manipulated to produce different perceptually convincing sounds. For example, the digitized sound can be visually inspected at several different scales (i.e., expansion and contraction in the time domain). Then, the characteristic shape of the sound at different resolutions can be matched to a wavelet type. Some sounds have very rapid, sharp transitions; there are wavelet types that also have this characteristic. Other wavelets have smooth, gradual transitions. These wavelets would better match (i.e. produce higher coefficient values overall) sounds with smooth transitions.

For the parameterized wavelet models presented as examples below, wavelet function $\psi$ and corresponding scaling function $\phi$ were selected from the Daubechies family of wavelets, described in "Wavelet Toolbox", The Math Works, Inc., incorporated herein by reference. A wavelet representation of the original digitized sound can be obtained using the discrete wavelet transform (DWT) which employs a set of filtering and decimation (or down sampling) operations to obtain two sets of coefficients (approximation and detail) which completely describe the original sound. Alternatively, continuous wavelet transform (CWT) or fast wavelet transform (FWT) can be used to obtain a wavelet representation of the sound.

Figure 2:
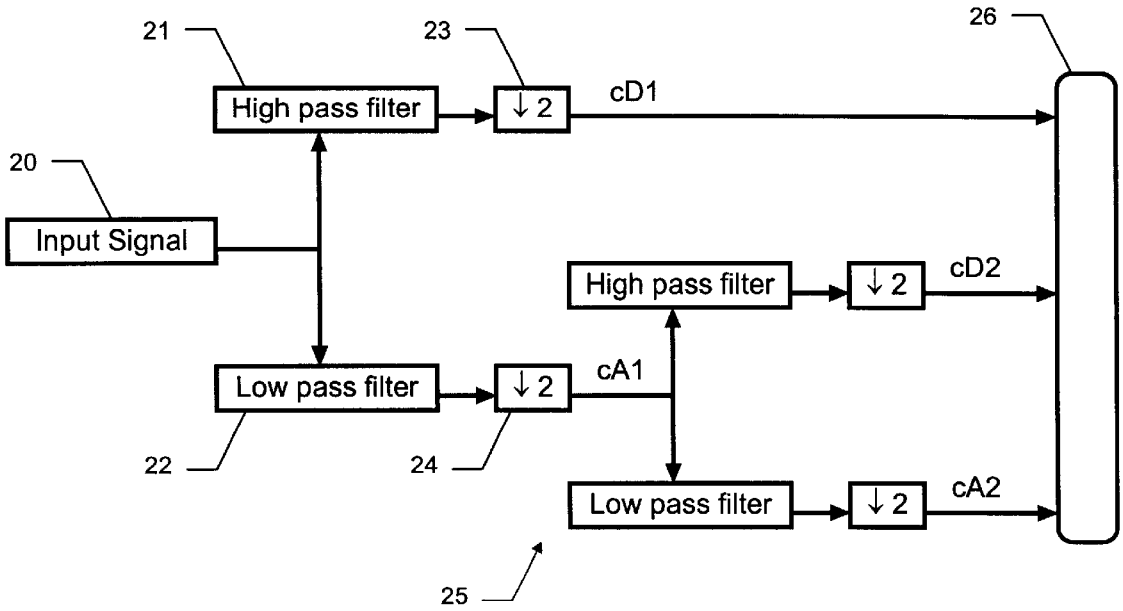
FIG. 2 is an illustration of wavelet decomposition.

As an example, the original digitized sound can be decomposed using the Discrete Wavelet Transform (DWT) method. FIG. 2 shows a high level block diagram of the decomposition steps. The DWT employs a series of decomposition stages consisting of filtering and decimation operations. The first step in the decomposition is to convolve the input signal 20 with high-pass and low-pass filters 21, 22. The structure of the filters are defined by the choice of wavelet type and scale function. Next, the filtered signals undergo dyadic decimation (or down sampling by 2) 23, 24. The result is a level 1 approximation coefficient vector cA1 and detail coefficient vector cD1. Each of the coefficient vectors can be used as inputs to successive wavelet decomposition stages 25. For an input signal of length N, the DWT consists of $\log_2 N$ stages at most. The end result is a set 26 of coefficients (approximation and detail) which describe the original sound.

Software systems which support wavelet operations typically contain single level or multi-level wavelet decomposition functions. In Matlab™, these functions are dwt and wavedec respectively. Typical inputs required for these types of functions include an input signal vector, the desired decomposition level, and the wavelet type. Users can supply the specific decomposition filters to be used in lieu of the wavelet type. The output from this type of function is typically a set of coefficient vectors and corresponding vector lengths. For example, in Matlab™, a signal X is decomposed to level 3 using the Daubechies #2 wavelet type (db2) with the command $$[C,L]=\text{wavedec}(X,3,\text{db2}).$$

The wavelet coefficients are contained in the vector C and the corresponding vector lengths are contained in L. The wavelet coefficients can then be manipulated in the parameterization phase.

Parameterization

The wavelet decomposition coefficients are the source of parameters for subsequent sound synthesis. Manipulating the model parameters (i.e., varying the wavelet coefficients) can yield a variety of synthesized sounds related to the original digitized sound. Essentially unlimited control in amplitude, time and frequency is available; however, the model parameters are not necessarily directly related to the physical characteristics of the sound source. Determining the sound model parameterization can be largely an iterative process, with sound model parameterizations based on the perceptual sound characteristics.

For example, a large sound source (such as an airplane engine) will likely have large approximation coefficients cAx, indicating a significant contribution of low frequency information. An airplane engine sound can be converted into the sound of a car engine by de-emphasizing the approximation coefficients cAx and enhancing the detail coefficients cDx (high frequency components). Next, the sound can be synthesized using the modified approximation and detail coefficients and played for a listener's perceptual inspection. If the listener perceives that more high frequency information is required to make the sound more perceptually convincing, the detail coefficients cDx can be further enhanced. This process can iterate until a clear definition of coefficient manipulations is established for changing the original sound into a variety of new synthesized sounds.

As another example, increasing the low frequency content of a sound model can result in the perception of a larger sound source. Varying the low frequency and high frequency content of an engine model can turn the sound of a standard sized car engine into the sound of a large truck or a small toy car. Scaling filter parameter manipulations can shift the sound in frequency. Manipulations of this type can change the sound of a brook into the sound of a large, slow moving river, or into the sound of a rapidly moving stream. More sophisticated parameter manipulations, including combinations of simple manipulations, can create perceptually convincing synthesized sounds that are beyond the scope of the original sound. For example, manipulating the parameters of a rain model can result in the sound of applause or a machine room.

Figure 3:
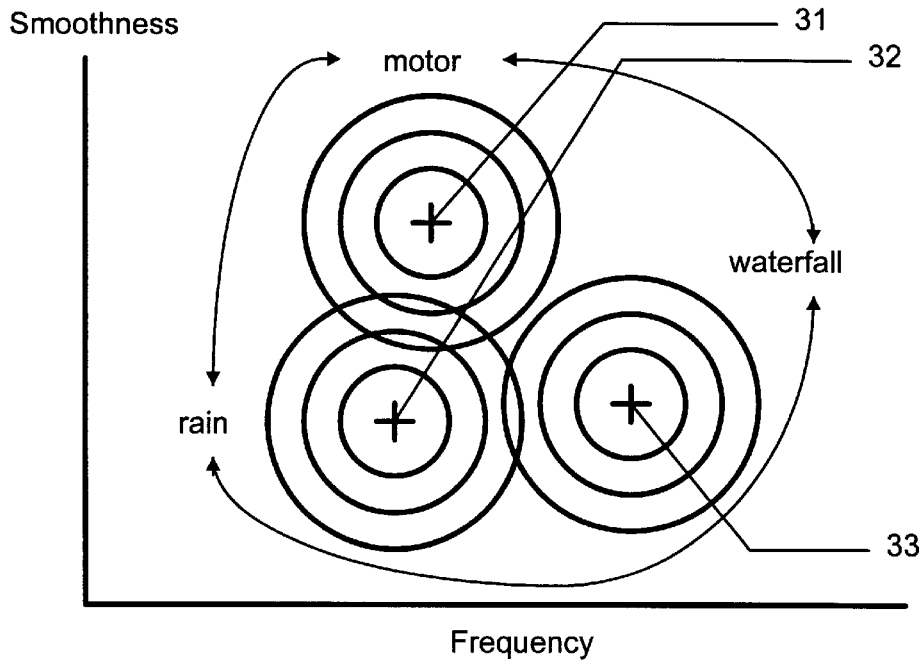
FIG. 3 is an illustration of a perceptual sound space obtained through physical parameter modifications.

Manipulation of the sound model parameters can be represented in a perceptual sound space. FIG. 3 depicts an idealized example of a synthesized sound space. The axes represent perceptual dimensions of the sounds as the perceived sound changes with changing model parameters. Each circle represents a variety of perceived sounds achievable from a single wavelet model. The center 31, 32, 33 of each circle represents the original digitized sound from which a model was developed. Parameter manipulation extends the sound perception into many dimensions. It is feasible to move from one type of sound to another by changing the parameter settings as indicated in FIG. 3 by the overlapping sound circles. For example, manipulating the rain model parameters creates a sound that includes the sound of light rain, medium rain, a heavy, rapid rainfall, a small waterfall, and some motor sounds.

Different types of parameterization methods are suitable for use with the present invention, including magnitude-scaling of wavelet coefficients to emphasize or de-emphasize certain frequency regions, scaling filter manipulations to frequency shift the original signal, and envelope manipulations to alter the amplitude, onset, offset, and duration of the sound. These parameterization methods, described below, can be used alone or in combination to produce compelling variations of the original sounds. Those skilled in the art will appreciate other parameterization techniques and manipulations that can also increase the power of a model by producing a greater variety of sounds.

Magnitude-Scaling

Figure 4:
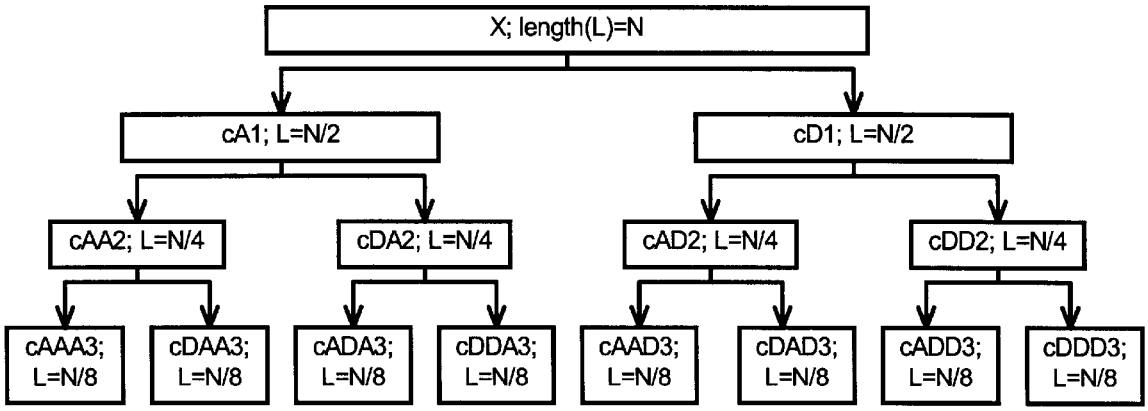
FIG. 4 is an example of a multilevel wavelet decomposition.

Magnitude-scaling of wavelet coefficients can change the frequency content of a sound. Because the number of wavelet coefficients resulting from a wavelet decomposition is large, it can be convenient to manipulate the wavelet coefficients in groups. Multi-level wavelet decomposition provides successively smaller groups of wavelet coefficients as the level of decomposition increases. Furthermore, the wavelet coefficients can be grouped according to frequency with the approximation coefficients representing the low frequency and the detail coefficients representing the high frequency signal components respectively. FIG. 4 shows an example of a complete 3-level wavelet decomposition of an input signal X. The lowest frequency components are represented by the approximation coefficient group cAAA3 and the highest frequency components are represented by the detail coefficient group cDDD3. The wavelet coefficient values represent the contribution made by each frequency to the overall signal. By manipulating the wavelet coefficients in groups, the overall frequency structure, and thus perceptual quality, of the original signal can be maintained.

The magnitude-scaling method involves changing the contribution of various frequency groups to synthesize a new perceptually similar sound. The magnitude-scaling method can also synthesize new perceptually different sounds. Various scaling techniques can be applied to wavelet coefficient groups to achieve different effects. The simplest manipulation is to multiply or divide a wavelet coefficient group by a scalar. This simple manipulation approach can be very powerful and effective. Many different perceptually related sounds can result from a scalar type of manipulation. For example, to make a car motor sound like a small toy engine, the contribution from the lowest frequency group can be reduced by dividing the cAAA3 coefficients by a scalar. Higher frequency information can be enhanced by multiplying a detail coefficient group, such as cDDA3 or cDDD3, by a scalar. Different combinations of manipulations on wavelet coefficient groups can result in a wide variety of perceptually related sounds. More complex manipulations can involve modifying wavelet coefficient groups by static or dynamic functions. The modifications are determined by the desired perceptual result.

Scaling Filter

Scaling filter manipulations can shift the sound in frequency: all frequency contributions remain fixed and the entire signal is shifted in frequency. For some wavelet families, such as the Daubechies wavelets, the scaling filter can be used to compute the decomposition and reconstruction filters. By stretching or compressing the scaling filter upon reconstruction, the original signal frequency content can be shifted down or up respectively. Scaling filter manipulations can change the sound of a brook to the sound of a large, slow moving river (stretching scaling filter), or to the sound of a rapidly moving stream (compressing scaling filter).

There are four steps involved in the scaling filter manipulation method:

1 Decompose an original signal X using a Daubechies wavelet, or other wavelet family with scale filter support. A Y level decomposition using Daubechies wavelet dbN can be performed in Matlab™ by:

```
[C,L]=wavedec(X,Y,'dbN');
```

2 Obtain the scaling filter associated with the wavelet. In Matlab™, the dbwavf command returns the scaling filter in the vector f:

```
f=dbwavf('dbN');
```

3 Extract the standard reconstruction scaling filters from the wavelet so that it can be modified. In Matlab™, this can be accomplished as follows:

```
LP_R_F=f/norm(f); % obtain the low pass reconstruction filter
HP_R_F=qmf(LP_R_F); % obtain the high pass reconstruction filter.
```

4 Perform compression or expansion operations on the reconstruction scaling filter. These operations can be accomplished with a number of different methods such as linear interpolation or B-spline interpolation, followed by resampling. Through ad hoc experimentation, B-spline interpolation was found to be superior to linear interpolation in terms of maintaining the perceptual quality of the original sound. In Matlab™, the commands for performing a B-spline interpolation and resampling to create a new scaling filter are:

```
xl=1:size(LP_R_F,2);
xli=1:(1/compression_or_expansion_factor):size(LP_R_F,2);
yli_r=interp1(xl,LP_R_F,xli,'spline');
xh=1:size(HP_R_F,2);
xhi=1:(1/compression_or_expansion_factor):size(HP_R_F,2);
yhi_r=interp1(xh,HP_R_F,xhi,'spline');
```

The new scaling filter is defined by yli_r and yhi_r.

Envelope Manipulations

Two classes of envelope manipulations can be used for the present sound synthesis method. The first type of manipulation involves envelope filtering of the wavelet parameters prior to synthesis. This is similar to the magnitude scaling approach except that the coefficients are modified by an envelope function instead of by a scalar value. The shape of the function is determined by the perceptual effect desired. For example, a Gaussian-shaped envelope can be applied to a group, or groups, of wavelet coefficients, or across all wavelet coefficients. Then, the filtered wavelet coefficients undergo the normal synthesis process. The end result is a synthesized sound that is a derivation of the original sound, wherein the frequency region around which the Gaussian envelope was centered would be emphasized and the surrounding frequency regions would be de-emphasized. Any envelope shape can be applied to the wavelet coefficients including linear, non-linear, logarithmic, quadratic, exponential and complex functions. Random shapes, shapes derived from mathematical functions and characteristic shapes of sounds can also be applied.

The wavelet operations of compression and de-noising can be applied to the present sound synthesis method. Envelopes resulting in the compression of the number of wavelet coefficients can be useful for saving storage space and data transmission times. Compression and de-noising functions applied to wavelet coefficients can yield a variety of perceptually related sounds.

The second class imposes time domain filtering operations on all, or part, of the synthesized sound. These operations are applied to the sound after synthesis. Time domain filtering can alter the overall amplitude, onset and offset characteristics and duration of the sound. Again, any type of envelope shape can be applied to the synthesized sound. For example, an "increasing exponential" shaped envelope filter can be applied to the synthesized sound of a footstep-on-gravel to obtain the perceptual result of an explosion. Time domain filtering of amplitude with a random characteristic can be applied to the rain synthesis to obtain a continuously varying and natural sounding rainstorm (additional wavelet parameter enveloping of the rain model also enhances the "natural" rainstorm sound).

Synthesis

Synthesis employs an Inverse Wavelet Transform (IWT). The parameters (modified wavelet coefficients) are the inputs to the IWT. The output of the synthesis phase is a synthesized sound for use in applications and validation experiments.

Figure 5:
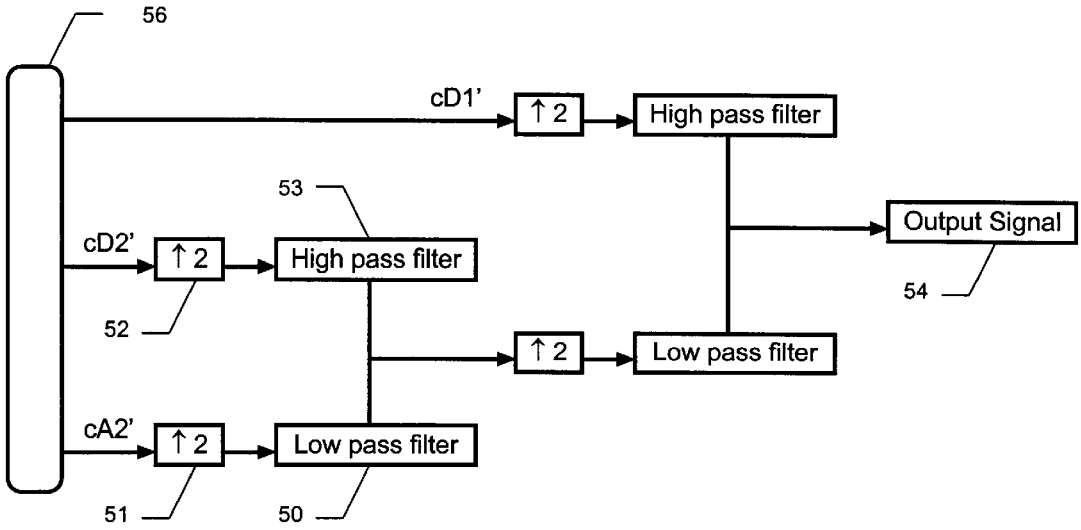
FIG. 5 is an illustration of wavelet reconstruction.

A sound can be synthesized using the Inverse Discrete Wavelet Transform (IDWT), the Inverse Continuous Wavelet Transform (ICWT), or the Inverse Fast Wavelet Transform (IFWT). FIG. 5 shows a high level block diagram of IDWT synthesis. The IDWT starts with the complete set 56 of parameters (modified wavelet coefficients) and constructs a signal by inverting the decomposition steps. The reconstruction is accomplished through a series of stages consisting of upsampling 51, 52 and filtering 50, 53 operations. The first reconstruction step 51, 52 upsamples the lowest level coefficient vectors by a factor of 2, inserting zeros at odd-indexed elements. Next, the upsampled vectors are convolved with high-pass 53 and low-pass 50 filters. The structure of the filters are determined by the choice of wavelet type and scale function. The combination of all four filters used in the decomposition and reconstruction phases form a set of quadrature mirror filters. Successively higher levels of coefficient vectors are reconstructed using the same process. This continues until all coefficient vectors have been reconstructed. The end result is a final waveform 54 containing the synthesized sound which can be saved for later use or converted to an audio format and played for a listener.

Software systems which support wavelet operations typically contain a single level or multi-level wavelet reconstruction function. In Matlab™, these functions are idwt and waverec respectively. Functions of this type require as inputs a set of coefficient vectors, the length of the vectors, and the wavelet type. Users can supply the specific reconstruction filters to be used in lieu of the wavelet type. For example, in Matlab™, a signal X can be synthesized from a coefficient vector C, with lengths specified by L and wavelet type db2 with the command

```
X=waverec(C,L,db2).
```

The output from this type of function is the final synthesized signal. The synthesized signal can be converted to a standard audio file format and then sent to an audio output device for playback, or can be stored in storage media for later use, or can be transmitted over a computer network for remote application.

Examples

Several different wavelet-based continuous and finite-duration synthesized sound sequences serve as concrete examples of the present sound synthesis method. Continuous sounds are defined as very long duration steady-state sounds, such as wind, rain, stream and a waterfall. The onset (starting) and offset (ending) sound characteristics are short as compared to the steady-state signal duration and do not significantly influence the sound perception. Continuous sound synthesis examples include rain, a 2000 RPM motor, and a brook. Finite-duration sounds are defined as time limited sounds whose on-set and off-set characteristics significantly influence the sound perception. Finite-duration sound synthesis examples include a footstep on gravel, glass breaking, and shuffling deck of cards. All of the base sounds were digitized at a 22050 Hz sample rate and 16-bit resolution with a Digital Audio Tape (DAT) recorder and a studio quality microphone.

Equipment

Development of these examples was accomplished on a workstation consisting of a Network Computing Devices (NCD, model MCX) smart terminal, 17" color display and an embedded sound board. The workstation was driven by a Sun Sparc Server 20 host computer. Synthesized sounds were listened to through both workstation speakers and AKG K240 stereo headphones.

Parameter Settings

To demonstrate the effect of varying model parameters, four different parameterizations were applied to each base sound. The first two parameterizations (1,2 in Table 1) magnitude scaled different groups of coefficients. For these parameter manipulations, each of the base sounds was decomposed to level 5 using the Daubechies 4 (db4) wavelet type. The two magnitude scaled parameterizations used were level 1 detail coefficients (cD1) scaled by eight, and level 5 approximation coefficients (cA5) scaled by four. The next two parameterizations (3,4 in Table 1) involved scaling filter manipulations of the reconstruction scale function. For these parameterizations, each of the base sounds was decomposed to level 5, using the Daubechies 6 (db6) wavelet type which has a 12-point reconstruction scaling filter. One parameterization increased the number of points in the reconstruction scaling filter to stretch the filter and thereby shift the sound down in frequency. The final parameterization decreased the scaling filter length (compressed the filter) thereby shifting the sound up in frequency. The filter stretching and compression settings were selected based on the lowest and highest possible frequency shifts, respectively, while still maintaining a perceptually compelling sound. Table 1 summarizes the parameter settings, starting with the six sounds and creating 24 new sounds (4 different parameter settings for each of the six original sounds).

TABLE 1

| | Parameter Settings | | | |
|---|---|---|---|---|
| Sound Group Original Sound | 1 Scale Details | 2 Scale Approx. | 3 Num Filter Points | 4 Num Filter Points |
| Rain | cD1 * 8 | cA5 * 4 | 17 | 7 |
| Car Motor | cD1 * 8 | cA5 * 4 | 17 | 9 |
| Brook | cD1 * 8 | cA5 * 4 | 17 | 9 |
| Footstep | cD1 * 8 | cA5 * 4 | 17 | 9 |
| Breaking Glass | cD1 * 8 | cA5 * 4 | 20 | 7 |
| Shuffling Cards | cD1 * 8 | cA5 * 4 | 17 | 8 |

Parameterized models were created for many different sounds. The six original sounds and 24 synthesized sounds in Table 1 were used in perceptual experiments to test the present sound synthesis method. A description of these sound models and perceptual experiment results, using the above parameter settings, follows.

Rain

This model simulated the sound of rain. Parameter manipulations yielded the synthesis of light rain, medium rain and progressively heavier rain. The perception of increasing wind accompanied the sound of increasing rain and conveyed the sense of a large rainstorm. Other perceptually grouped sounds that emerged from the rain model were bacon frying, machine room sounds, a waterfall, a large fire, and applause.

Brook

This model simulated the sound of a babbling brook. Parameter adjustments resulted in the synthesis of various levels of stream activity level from a calm stream to a raging river. Additional parameter adjustments varied the stream size from very wide to narrow. Listeners found that the brook sound was converted into the sound of a wide, calm, deep river and further converted into the sound of a waterfall with the different parameter settings. Other parameter settings yielded the perception of a heavy rainstorm, water from faucet, water running into a bathtub, television static, and a printing press.

Car Engine

This model simulated the sounds of a car engine idling with parameter adjustments for different sized cars, different type of engines and different RPMs. Adjusting the parameters as described above resulted in the perception of a large diesel truck, a standard truck, a mid-sized car, and a toy car as evidenced through perceptual experiments. Other parameter settings yielded the perception of machinery, construction site machines, tractor, jackhammer, drill, helicopter propellers, and various sized airplane engines.

Footsteps

This model simulated the sound of footsteps on gravel. Parameter manipulations resulted in the perceptions that the footsteps were on different material types such as dirt, a hard concrete floor or a wood floor. Further parameter adjustments yielded the perception of varying weights for the person walking. Experiments with the above parameter settings revealed the following perceptually grouped sounds emerging from the model: chewing, crumbling paper, crushing or dropping various objects (from soft to hard objects), stomping of horse hooves, stepping on leaves, footstep in the snow, lighting a gas grill, a lion's roar, and gunfire.

Glass Breaking

This model simulated the sound of breaking glass with parameter adjustments for the glass thickness or density, the surface hardness on which the glass is breaking, and the force of impact. Exercising this sound synthesis model during perceptual experiments resulted in responses of dropping a heavy glass on a wood floor, throwing a fine piece of crystal against a concrete floor, breaking a window, keys falling to the floor, and breaking a plate or a pot.

Deck of Cards Shuffling

This model simulated the sound of a deck of cards being shuffled. Perceptually grouped sounds resulting from preliminary perceptual experiments included wind hitting a loose object (a flag or a rug), breaking sticks, twigs or spaghetti noodles, wings flapping, paper burning, cloth ripping, biting into a cracker or apple, fireworks, opening Velcro, and a motorcycle starting up.

Validation

Three psychoacoustic experiments were used to validate the sound synthesis veracity. A first experiment employed the self-similarity technique from psychophysics to illuminate the sound space and possible sound clustering. This experiment was used to understand the interrelationships between synthesized sounds. In this experiment, listeners rated the similarity between two synthesized sounds on a 5-point rating scale. Every possible combination of sound pairs was presented in random order. The similarity rating data was analyzed with two different methods. The first method derived a graph representing the conceptual relatedness using the Pathfinder scaling algorithm. The second method used multidimensional scaling (MDS) analysis which resulted in a mapping of the synthesized sounds onto a multidimensional perceptual space. Examination of these analysis results provided a better understanding of the perceptual sound clustering occurring through parameter manipulation.

The self-similarity experiment provided evidence that manipulations of the wavelet coefficients for these sound models results in perceptually convincing synthesized sounds. Furthermore, the experiment revealed that physical parameter manipulations translate directly to perceptual variations in the sounds. These results indicated that wavelet sound models can be parameterized and manipulated in ways that predictably produce perceptually compelling results.

A second experiment examined the perceptual identification of the synthesized sounds. Subjects listened to synthesized sounds and entered a free form identification description. Identification phrases included a noun and descriptive adjectives. Subjects were asked to think of the sound source when formulating the descriptions. There was no time limit and subjects were permitted to replay the sounds. Response times were measured so that uncertainty values could be calculated.

The free-form identification experiment provided evidence as to the variety of sounds that could be created from individual sound models. The effect of changing parameter values was reflected directly in the subject's responses. This information is useful for refining model parameterizations to yield synthesized sounds with particular perceptual characteristics. This experiment proved that the method produces a variety of sounds from a small set of models and that the sounds bring to mind perceptually convincing images.

A third experiment measured the perceptual sound veracity. Phrases obtained from the second experiment were paired with synthesized sounds. The phrases provided a perceptual context for the sounds. Subjects were asked to rate how well the phrases matched the sounds they heard. Ratings were on a 5-point scale, with 1=no match and 5=perfect match. Both digitized and synthesized sounds were included in the experiment. Examining the digitized sound ratings provided a standard to which the synthesized sound ratings could be compared. In this way, evaluation of sound veracity within a verbal context was obtained.

The third experiment provided a metric for measuring the compellingness of the synthesized sounds. The results indicate the quality of the model parameterizations. For example, the experiment showed that the rain model with the cD1*8 parameter setting synthesized a "very good" sound of "light rain", and a "good" sound of "shower water running". The rain model with the cA5*4 parameter settings produced a "very good" sound of "hard rain" and a "good" sound of a "large waterfall". Thus, this experiment measures the extent to which the sound synthesis succeeds in creating perceptual images. This information can be used to refine the model parameterizations and find settings that produce compelling sounds.

Examination of the perceptual experiment results indicated whether design iteration was necessary. Iteration of the design process refined the synthesis model to obtain the desired perceptual characteristics. Reanalysis of the model involved iterating through the process starting either with a new wavelet representation or a modified parameterization.

The particular sizes and equipment discussed above are cited merely to illustrate particular embodiments of the invention. It is contemplated that the use of the invention may involve components having different sizes and characteristics. It is intended that the scope of the invention be defined by the claims appended hereto.

We claim:

1. A method for generating a synthesized sound, comprising:

a) obtaining a wavelet representation of a first sound according to:

i) determining a characteristic shape of the first sound by inspecting the first sound at each of a plurality of scales;

ii) comparing the characteristic shape with each of a plurality of wavelet types;

iii) selecting the wavelet type from the plurality of wavelet types that most closely matches the characteristic shape;

iv) obtaining a wavelet representation of the first sound using a wavelet transform of the first sound based on the selected wavelet type;

b) obtaining a plurality of parameters which characterize the wavelet representation; and c) generating the synthesized sound by varying at least some of the plurality of parameters.

2. The method of claim 1, wherein the step of obtaining a wavelet representation comprises obtaining a digitized representation of the first sound.

3. The method of claim 2, wherein the step of obtaining a digitized representation of the first sound is selected from the group consisting of:

a) digitizing an analog recording of the first sound;

b) digitizing the first sound in real-time;

c) reading the digitized representation of the first sound from storage media; and d) accepting the digitized representation from a computer simulation of a physical event resulting in the first sound.

4. The method of claim 1, wherein varying at least some of the plurality of parameters in the step of generating a synthesized sound comprises magnitude scaling of the wavelet representation.

5. The method of claim 1, wherein the step of generating the synthesized sound comprises:

a) determining a wavelet type corresponding to the wavelet representation;

b) determining a wavelet reconstruction level corresponding to the wavelet representation;

c) determining a wavelet reconstruction structure corresponding to the wavelet representation;

d) constructing the synthesized sound using an inverse wavelet transform of the wavelet representation, the wavelet type, the wavelet reconstruction level, and the wavelet reconstruction structure.

6. The method of claim 5, wherein the inverse wavelet transform in the step of constructing the synthesized sound is selected from the group consisting of: inverse discrete wavelet transform, inverse continuous wavelet transform, and inverse fast wavelet transform.

7. The method of claim 1, further comprising communicating the synthesized sound.

8. The method of claim 7, wherein the step of communicating the synthesized sound is selected from the group consisting of: generating an audio signal of the synthesized sound, storing the synthesized sound in storage media, and transmitting the synthesized sound over an electronic network.

9. The method of claim 1, wherein the first sound is a stochastic-based sound.

10. The method of claim 1, wherein varying at least some of the plurality of parameters in the step of generating a synthesized comprises envelope manipulations of the wavelet representation.

11. The method of claim 10, wherein the first sound is a stochastic sound.

12. The method of claim 1, wherein varying at least some of the plurality of parameters in the step of generating a synthesized sound comprises changing the time base of the wavelet representation.

13. The method of claim 12, wherein the first sound is a stochastic sound.

14. A method for generating models for synthesizing sounds, comprising:

a) obtaining a digitized representation of a first sound;

b) obtaining a wavelet representation from a wavelet decomposition of the first sound, according to:

i) determining a characteristic shape of the first sound by inspecting the first sound at each of a plurality of scales;

ii) comparing the characteristic shape with each of a plurality of wavelet types;

iii) selecting the wavelet type from the plurality of wavelet types that most closely matches the characteristic shape;

iv) obtaining a wavelet representation of the first sound using a wavelet transform of the first sound based on the selected wavelet type; and c) parameterizing the wavelet representation to yield a model for synthesizing sounds.

15. The method of claim 14, wherein the step of obtaining a digitized representation of a first sound is selected from the group consisting of:

a) digitizing an analog recording of the first sound;

b) digitizing samples of the first sound in real-time;

c) reading the digitized representation of the first sound from storage media; and d) accepting the digitized representation from a computer simulation of a physical event resulting in the first sound.

16. The method of claim 14, wherein the step of parameterizing the wavelet representation comprises magnitude scaling of the wavelet representation.

17. The method of claim 14, wherein the first sound is a stochastic-based sound.

18. The method of claim 14, wherein the step of parameterizing the wavelet representation comprises envelope manipulations of the wavelet representation.

19. The method of claim 18, wherein the first sound is a stochastic sound.

20. The method of claim 14, wherein the step of parameterizing the wavelet representation comprises changing the time base of the wavelet representation.

21. The method of claim 20, wherein the first sound is a stochastic sound.

22. A method for synthesizing a sound with specified perceptual characteristics from a parameterized wavelet representation, comprising:

a) manipulating the parameterized wavelet representation according to:

i) selecting coefficients from the wavelet representation;

ii) generating a test wavelet representation by changing the values of the selected coefficients in the wavelet representation;

iii) generating a test sound from the test wavelet representation;

iv) evaluating the test sound for conformance with the specified perceptual characteristics; and v) repeating steps i) through v) until the test sound conforms to the specified perceptual characteristics;

b) constructing a synthesized sound from a wavelet reconstruction of the wavelet representation after manipulation;

c) communicating the synthesized sound.

23. The method of claim 22, wherein the step of constructing a synthesized sound comprises:

a) determining a wavelet reconstruction level corresponding to the wavelet decomposition level;

b) determining a wavelet reconstruction structure corresponding to the wavelet decomposition structure;

c) constructing the synthesized sound using an inverse wavelet transform of the wavelet representation, the wavelet type, the wavelet reconstruction level, and the wavelet reconstruction structure.

24. The method of claim 23, wherein the inverse wavelet transform in the step of constructing the synthesized sound is selected from the group consisting of: inverse discrete wavelet transform, inverse continuous wavelet transform, and inverse fast wavelet transform.

25. The method of claim 22, wherein the first sound is a stochastic-based sound.

* * * * *